US005887386A

United States Patent [19]

Alexanian et al.

[11] Patent Number: 5,887,386

[45] Date of Patent: Mar. 30, 1999

[54] WINDOW SHUTTERS WITH MOVABLE LOUVERS

[75] Inventors: Zachary C. Alexanian, Bradford; Jeffrey A. Stewart, Amesbury, both of Mass.

[73] Assignee: Timeless Shutters Incorporated, Merrimac, Mass.

[21] Appl. No.: 67,204

[22] Filed: Apr. 28, 1998

[51] Int. Cl.[6] ..... E06B 7/08

[52] U.S. Cl. ..... 49/403; 49/74.1

[58] Field of Search ..... 49/74.1, 403, 73, 49/92.1

[56] References Cited

U.S. PATENT DOCUMENTS

| | | | |
|---|---|---|---|
| 118,454 | 8/1871 | Hobbs . | |
| 125,887 | 4/1872 | Fowler . | |
| 165,812 | 7/1875 | Fletcher . | |
| 188,908 | 3/1877 | Hopkins et al. . | |
| 207,026 | 8/1878 | Fuller . | |
| 213,343 | 3/1879 | Morstatt . | |
| 229,226 | 6/1880 | Rolfe . | |
| 345,689 | 7/1886 | Hayes . | |
| 360,058 | 3/1887 | Snell et al. . | |
| 368,808 | 8/1887 | Cahill . | |
| 390,392 | 10/1888 | Niss | 49/403 X |
| 472,592 | 4/1892 | Swartz . | |
| 702,148 | 6/1902 | Nettleton | 49/403 |
| 709,239 | 2/1902 | Cooper . | |
| 3,129,471 | 4/1964 | Johnson et al. . | |
| 3,153,819 | 10/1964 | Bond . | |
| 3,292,309 | 12/1966 | Horner . | |
| 3,584,567 | 6/1971 | Roach | 98/119 |
| 3,691,687 | 9/1972 | Economou | 49/74 |
| 3,759,054 | 9/1973 | Graber | 62/183 |
| 3,759,056 | 9/1973 | Graber | 62/183 |
| 4,033,073 | 7/1977 | Bogan | 49/38 |
| 4,327,795 | 5/1982 | Wheeler | 160/98 |
| 4,327,796 | 5/1982 | Rochman | 160/101 |
| 4,480,674 | 11/1984 | Anderson | 160/107 |
| 4,577,619 | 3/1986 | Howe, Jr. | 126/431 |
| 4,709,506 | 12/1987 | Lukaszonas | 49/88 |
| 4,723,586 | 2/1988 | Spangenberg | 160/107 |
| 4,792,427 | 12/1988 | Reeves | 264/285 |
| 4,887,391 | 12/1989 | Briggs, Sr. | 49/90 |
| 4,936,048 | 6/1990 | Ruggles | 49/74.1 |
| 5,035,046 | 7/1991 | Cowing | 29/714 |
| 5,168,913 | 12/1992 | Haines | 160/168.1 |
| 5,178,200 | 1/1993 | Hagen | 160/107 |
| 5,187,896 | 2/1993 | Ross | 49/74.1 |
| 5,216,837 | 6/1993 | Cleaver et al. | 49/82.1 |
| 5,238,042 | 8/1993 | Guerrico-Echeverria | 160/104 |
| 5,275,219 | 1/1994 | Giacomel | 160/6 |
| 5,303,507 | 4/1994 | Oille | 49/74.1 |
| 5,339,591 | 8/1994 | Underdahl | 49/74.1 X |
| 5,347,756 | 9/1994 | Abbott et al. | 49/74.1 |
| 5,599,051 | 2/1997 | Bourgeois | 292/262 |

*Primary Examiner*—Jerry Redman

[57] ABSTRACT

Movable louvered window shutters embody a construction and a process for their fabrication that results in a shutter having a high quality, functionally and aesthetically. The shutters use a hardware arrangement including two types of louver pins, a compression spring and a tensioning mechanism to adjust the frictional drag on the shutters. The hardware facilitates a procedure in which the frame and louvers of the shutter are fabricated and finished separately and then assembled. The same kit of hardware can be used to make virtually any size window shutter having movable louvers. The tensioning mechanism includes a threaded insert that enables adjustment of the frictional drag on the louvers without causing deterioration or damage to the shutter frame.

6 Claims, 4 Drawing Sheets

WINDOW SHUTTERS WITH MOVABLE LOUVERS

FIELD OF THE INVENTION

This invention relates to window shutters with movable louvers and to techniques for their fabrication.

BACKGROUND OF THE INVENTION

A common technique to make a wood window shutter with movable louvers, particularly a shutter intended to be marketed as "low-cost" or "economy" grade, is to fabricate and assemble the entire shutter and then paint it as an assembled unit. Paint tends to collect, however, in the pivotal joints by which the louvers are mounted to the frame of the shutter resulting in reduced function and aesthetic appeal. Consequently, with such a shutter manufacturing technique, it is common to increase the clearance to reduce the risk of freezing or binding of the joint with hardened paint. That tends to result in loose, uneven joints. While it has been suggested, as in Briggs U.S. Pat. No. 4,887,391, that these difficulties may be avoided by forming and finishing the frame and the louvers separately, and then attaching the louvers to the frame, there is a need for a simplified, yet effective, arrangement by which the pivoted position of the louvers, when adjusted, is maintained. The aforementioned Briggs patent describes an arrangement in which a magnetically engageable ganging bar is connected to each of the louvers between one of the stiles of the frame and the ends of the louvers adjacent that stile, coupled with magnets mounted to the frame for engaging the ganging bars and securing them in an adjusted position. A common arrangement that has been employed, particularly in preassembled louvered shutters is to drive a wood screw into and through the frame of the shutter so that its end bears against the end of a louver pin at the end of the louver. By tightening the screw, the other end of the louver can be urged against the opposite side of the frame to develop sufficient friction that will tend to retain the louvers in an adjusted position, a technique that is referred to as "tensioning". Over time, the threaded engagement of the screw directly with the wood of the frame and the pin at the end of the shutter can be expected to become worn from periodic adjustments of the louvers and other causes. The Briggs patent refers to other approaches in which a heavy spring is applied against either or both ends of each louver to maintain what is referred to as "axial tension" on the louver. Briggs explains that such movement action, however, is "somewhat jerky".

Also among the diffculties that may be encountered with some movable louvered shutters is that the hardware that is associated with the shutter may differ from one shape or configuration of shutter to another. In such instances, it may become necessary for a substantial inventory of components to be maintained for each of the different size or configuration of shutter. For example, it may be necessary to maintain an inventory of a variety of springs, pins or the like in different sizes for use with different sized shutters or configurations. Not only does that present inventory difficulties but it also presents an opportunity for assembly mistakes to be made, as by putting the wrong hardware item in a particular shutter.

There is a need for a movable louvered shutter and technique for its fabrication in which the shutter components fit closely, function properly and reflect aesthetically, a high degree of craftsmanship and further in which the arrangement for maintaining the louvers in an adjusted, aligned position is simple, inexpensive and will not result in damage to the frame or the louver from repeated adjustment of the tension on the louvers. There also is a need for a movable louvered shutter that requires relatively few hardware components and which those components can be used to fabricate a wide variety of such shutters of virtually any size.

SUMMARY OF THE INVENTION

In a window shutter made in accordance with the invention, the frame and louvers are fabricated and finished separately. The frame may be considered as having a first side member and a second, spaced, side member. Top and bottom members connect the ends of the side members together in a unitary frame. The louvers are arranged to be pivotally mounted to and between the first and second side members. Each louver is provided at one end with a first louver pin, one end of which is received in the socket in one of the side members and the other end is received in a socket in the end of the louver. One of the pins associated with each louver is provided with a bearing face against which the end of the louver can bear. Most of the louvers are provided, at their other end, with a second louver pin that can be received and resiliently depressed into a socket formed in the other side member, there being a light compression spring in the bottom of the socket. Each compression spring serves to bias its associated louver lightly against the bearing surface on the opposed pin. The bearing surfaces are arranged to be in alignment with each other and cooperate to define a reference line along which the ends of the louvers can be registered to maintain the louvers in precise alignment with each other. A "tensioning mechanism", is associated with at least one of the louvers and is in the form of an internally threaded insert and blunt threaded adjustment screw. The threaded insert is seated in a socket in the frame to enable the adjustment screw to bear against an end of a louver pin. The threaded insert is fixed in its position within the frame. The adjustable threaded member is not screwed into or through wood.

All of the light compression springs and pairs of pins may be identical regardless of the size or configuration of the shutter or the louvers. The improved tension device can be used uniformly for all such shutters. The arrangement of pins for mounting the louvers and the improved tension device simplifies assembly of the shutters without requiring different sizes or configurations of hardware components for the different shutters. The invention facilitates economic assembly of a high quality louvered shutter.

It is among the general objects of the invention to provide an improved movable louver shutter assembly in which the louvers and frame are fabricated and finished as separate subassemblies and in which the louvers can be snapped in and out of the frame.

Another object of the invention is to provide a technique for manufacturing movable louvered shutters in which uniform hardware components can be used for all sizes and configurations.

A further object of the invention is to provide a window shutter with a louver tension mechanism that serves as a simple and inexpensive control for maintaining the position of the adjusted louvers.

A further object of the invention is to provide a movable louver shutter assembly in which the tensioning mechanism can be adjusted repeatedly without causing substantial wear on the frame or the louver.

BRIEF DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
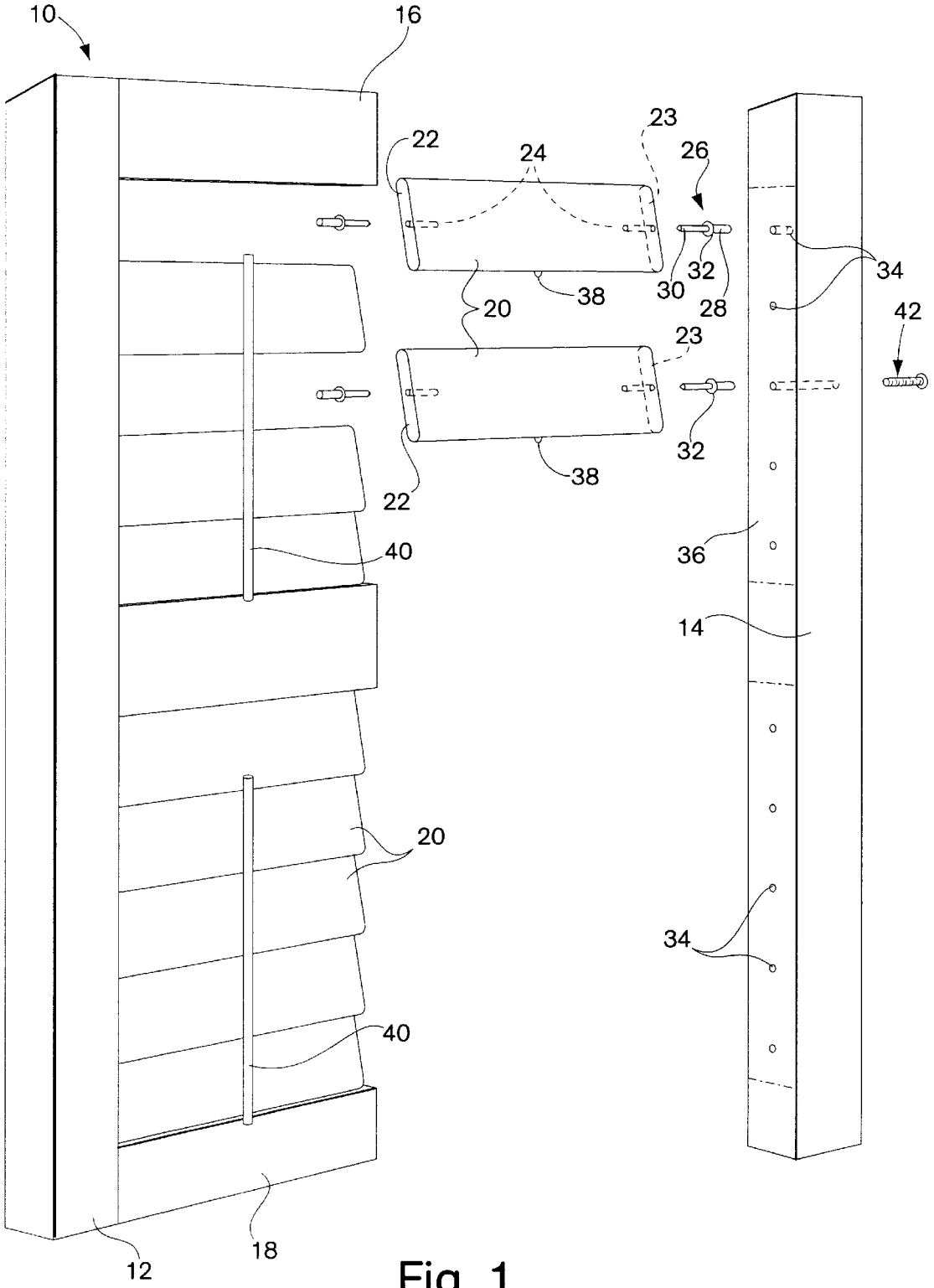
Fig. 1 (PRIOR ART)
FIG. 1 is a partially exploded, somewhat diagrammatic illustration of a typical prior art movable louvered shutter construction as may be completely assembled and then finished after assembly.

FIG. 1 shows the general configuration of a prior art shutter with movable louvers. The shutter includes a frame 10 that comprises a pair of vertical stiles defining first and second side members 12, 14 and a pair of horizontal rails 16, 18 that define top and bottom members. The rails 16, 18 are connected, at their ends, to the ends of the stiles 12, 14 by any suitable conventional corner joint (details not shown). The frame 10 defines an opening in which a plurality of pivotally mounted louvers 20 are located. FIG. 1 illustrates one of several typical constructions for shutters that are completely assembled before finishing and then are painted as a complete unit. Each louver 20 may be considered to have first and second end faces 22, 23 which, in the embodiment illustrated, may be provided with sockets 24. A louver pin 26, typically formed from a polymeric material such as nylon, is provided to mount the louvers by their ends for pivotal movement about an axis. The louver pin 26 may have an inner end 28, an outer end 30 and an enlarged flange 32 between and defining the two ends 28, 30. When assembled, the inner end 28 of the pin 26 extends into its associated socket 24 in the first end face 22 of the louver 20. The outer end 30 of each pin 26 is received in a socket 34 formed at the associated inwardly facing surface 36, 37 of the stiles 12,14. Each of the louvers 20 also is provided with a looped connector 38, such as a staple, by which the louvers 20 can be connected together by a vertical control rod 40. The louvers 20, connected to a single common control rod, will pivot in unison to a desired position. Typically, such preformed shutters are assembled using various jigs and fixtures to facilitate alignment of the numerous components. Other configurations have been used in the prior art for pivotally mounting the louvers 20 between the stiles 12,14. In another construction, the louvers are formed with an integral pin, formed as part of the louver itself, that projects from the end face.

Figure 2:
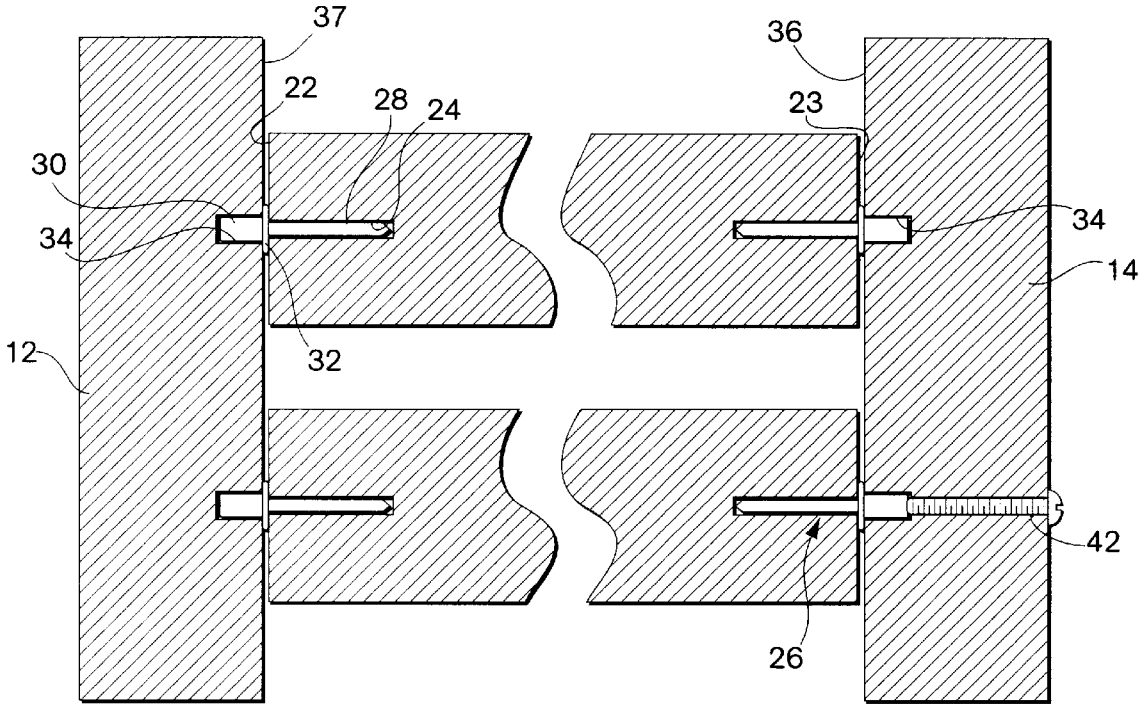
Fig. 2 (PRIOR ART)
FIG. 2 is a fragmented, somewhat diagrammatic vertical sectional illustration of a typical prior art construction as that of FIG. 1 showing the manner in which the louvers are pivotally mounted to the frame and the manner in which an end load is applied to "tension" one of the louvers.

FIGS. 1 and 2 also illustrate one type of "tensioning" system for maintaining the louvers in a set position. In this common arrangement a wood screw 42 is screwed into one of the stiles so that its inwardly directed end projects into its associated socket 34 to engage the outer end of the louver pin 26 with which it is aligned. The screw serves to drive the louver assembly (comprising the louver 20 and its associated louver pins 26) toward the opposite stile 12. The extent to which the screw 42 is driven into the stile 14 controls the extent to which the louver end face 22 adjacent the stile 12 and inner surface 37 of the stile 12 are compressed against the flange 32 of the shutter pin 26. The degree of compression (conventionally misnomered as "tension") determines the frictional drag between the flange and the end face 22 of the louver. After the entire device has been assembled, it then is finished, as by painting or the like. In another technique, referred to in Briggs U.S. Pat. No. 4,887,391, heavy springs can be incorporated at either or both ends of each louver pin to maintain the axial compressive load necessary to hold the louvers in a set position.

Figure 3:
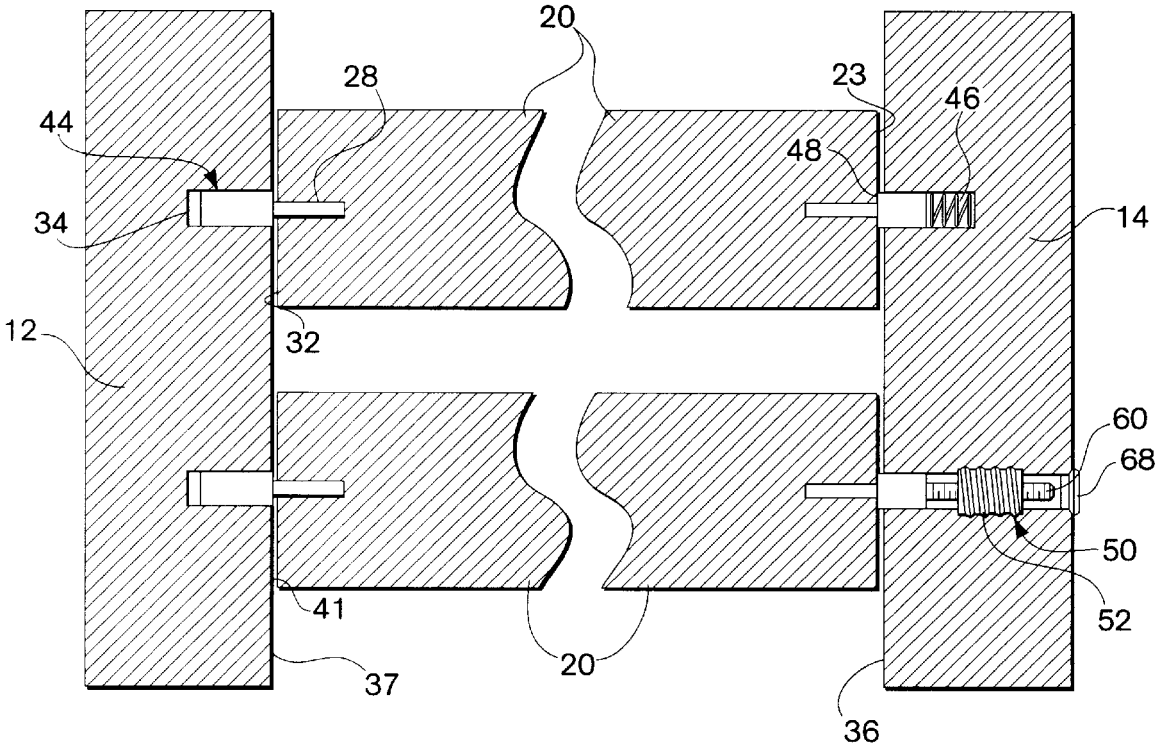
FIG. 3 is a sectional illustration of a shutter in accordance with the invention showing the internal components by which the louvers are pivoted to the frame and a "tensioning" mechanism that applies a compressive load to one or more of the louvers to maintain the louvers in an adjusted position.
Figure 3A:
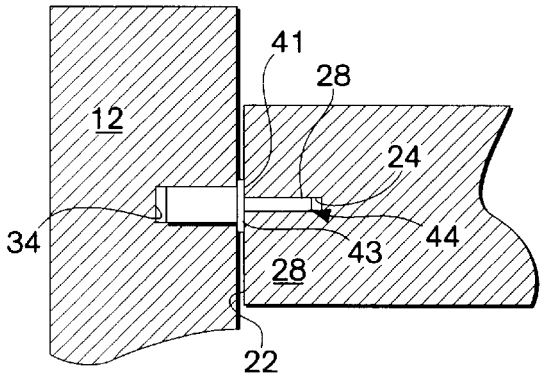
FIG. 3A is an enlarged sectional illustration of a louver pin of the type shown in FIG. 5 connecting one frame side member with an end of a louver.
Figure 4:
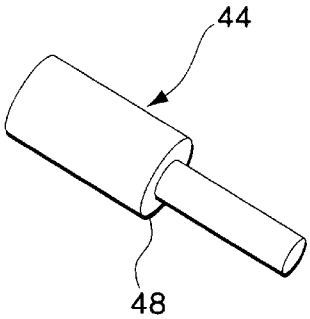
FIG. 4 is an illustration of a depressible louver pin adapted to be resiliently urged fully into its associated socket.
Figure 5:
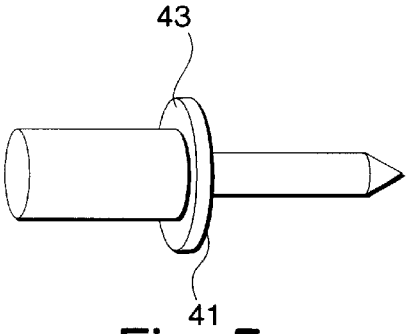
FIG. 5 is an illustration of a louver pin in which a bearing surface is provided to engage an end surface of a louver.
Figure 6:
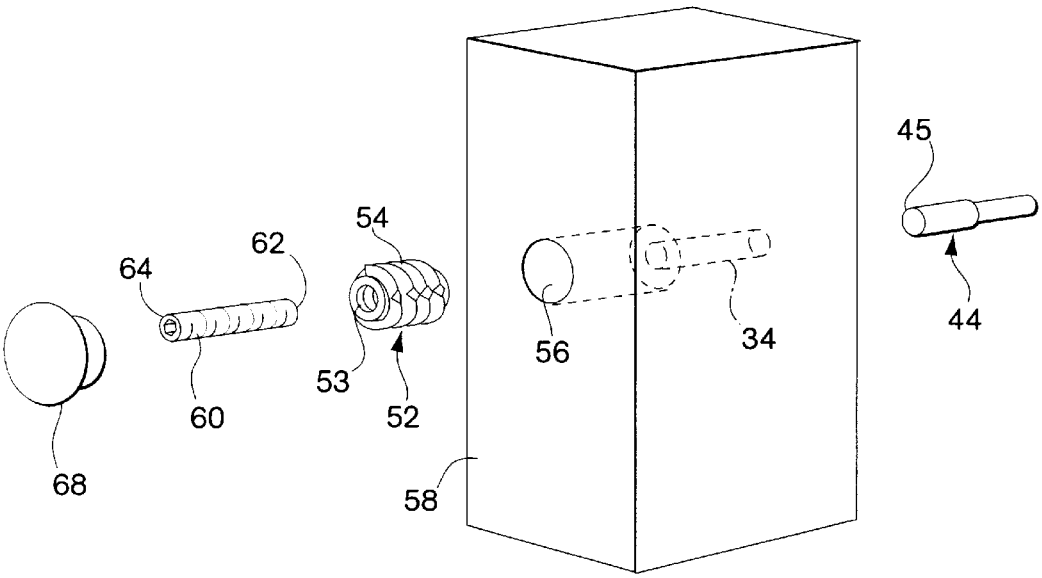
FIG. 6 is an exploded view of the components of the tensioning mechanism.

FIG. 3 illustrates a shutter embodying the present invention and the manner in which the louvers 20 are detachably connected to and between the first and second side members 12,14. In accordance with the invention, a first louver pin 44 is associated with the first end 22 of each louver. Each first louver pin 44, shown in further detail in FIG. 5, includes an inwardly facing bearing surface 41 that defines a diameter greater than that of the socket 34 in the first end 22 of the louver 20. The bearing surface 41 may be defined by an enlarged diameter flange 43. The first pins 44 are configured so that when they are inserted into their associated sockets 34 in the first side member 12, the bearing surfaces 41 of all of the first pins 44 will be vertically aligned, thereby providing a straight reference surface against which the first ends 22 of the louvers 20 can be registered. FIG. 4 illustrates a second embodiment of a louver pin 45 adapted to be received in sockets 34 formed in the second side member 14. The second louver pins 45 are configured so that their maximum diameter is not greater than the diameter of the socket 34 in the second side member 14 into which they are received. Additionally, the length of the second pins 45 and the depth of the sockets 34 are such that the pins 45 can be fully inserted into their respective sockets 34. The second pin 45 is adapted to be slidable within its associated socket 34. A light compression spring 46 is disposed within the socket 34 and is adapted to bear against the outer end of the second pin 45. The spring 46 should be selected so that it develops a light axial force tending to urge each second pin 45 toward the first side member 12. The spring biased pins 45 are selected to develop a force sufficient to urge the louvers 20 to cause their first ends 22 to bear against the bearing surfaces 41 of the first pins 44 but under a light force that presents no significant drag on the pivoting motion of its associated louver 20. The distance between the inner faces 36, 37 of the stiles 12,14 is slightly greater than the distance between the end faces 22 of the louvers 20. The gap 47 between the ends 22, 23 of the louvers and their associated side members should be the same, as determined, for example, by the thickness of the flange 43.

In order to apply sufficient and controllable frictional drag on the louvers, an improved "tensioning" mechanism 50 is provided. The tensioning mechanism 50, shown in exploded detail in FIG. 5, includes a threaded insert 52 having internal threads and external threads 54, or other suitable external surface configuration, to fix the insert in the frame. The insert 52 is adapted to be received in an enlarged diameter socket 56 formed in the outer face 58 of the second side member 14. The inner end of the socket 56 communicates with a smaller diameter socket 34 that is open on the inner surface of the second side member and receives a second louver pin 45. The insert 52 is threaded into the socket 56 to be seated securely within the socket 56. The external threads 54 on the insert 52 preferably are provided with interrupted surfaces that will facilitate permanent securement of the insert 52 within the socket 56.

A machine screw 60 is received within the internal threaded bore 53 of the insert 52. The inner end 62 of the screw 60 preferably is blunt so that it will bear against the outer face 45 of the pin 44 without digging into or otherwise causing damage to the louver pin 44. The outer end 64 of the screw 60 is provided with driver engageable surfaces, such as an Allen socket as shown. The frictional drag developed by the tensioning mechanism 50 on the louver associated with that mechanism can be adjusted by simply rotating the screw 60 in a tightening or releasing direction. The outer end 64 is easily accessed by prying off a button 68 that normally covers the socket 56. The button 68 is replaced in the socket 56 after the desired adjustment has been made. When the "tensioning" mechanism 50 is adjusted to increase the compressive load applied to the shutter 20, the first end face 22 of the shutter will bear against the bearing face of the first pin 26. Both end faces of the louver will be engaged by the same material. A polymer such as nylon has been found to provide good frictional drag characteristics, providing a smooth but firm feel, consistent with a high level of quality construction, without tending to bind up. Preferably bearing surfaces formed from the same polymer may be used to engage each of the end faces 22. The length of the socket 34 associated with the tensioning mechanism 50 should be long enough to enable the louver pin associated with that mechanism to be retracted substantially fully into its pin socket 34. By enabling that pin 45 to be fully withdrawn into its socket 34 (after the screw 60 has been backed off), it is not necessary for its associated second pin 45 to be fully depressible into its socket. We have found that for shutters having a height of up to about 30 inches, one tension mechanism 50, preferably associated with a middle region louver, is satisfactory. Where the length of the shutter is greater than about 30 inches, two tensioning mechanisms 50, suitably vertically spaced, may be desirable.

From the foregoing, it will be appreciated that the invention provides a number of advantages in the structure and operation of the shutter as well as in its fabrication. By forming the frame 10 and louvers 20 separately and by finishing them separately, the resulting product can evidence a high level of craftsmanship. The regions of the frame joints can be sanded more easily to a flat, smooth surface that, when painted, will reveal no evidence of the joint. The same components, including shutter pins, centering springs and the tension mechanism are usable for any size or configuration of louvered shutter. It is unnecessary to stock an inventory of different sized components, each adapted for one or a few sizes or configurations of shutters. Where the frame and louvers are formed and finished separately, there is no risk of paint being caught in the joints of the louvers and the frame. The louvers can be removed and replaced, for example, to change color schemes or to repair a broken louver. The tensioning mechanism can be repeatedly adjusted without causing adverse wear.

It should be understood that the foregoing description of the invention is intended merely to be illustrative thereof and that other modifications, embodiments and equivalents may be apparent to those skilled in the art without departing from its spirit.

Having thus described the invention, what we desire to claim and secure by Letters Patent is:

1. A louvered window shutter comprising:

a frame having spaced first and second side members and top and bottom members connecting the first and second side members to define an opening receptive to a plurality of louvers;

each of said first and second side members having a plurality of longitudinally spaced, inwardly facing sockets formed therein;

a plurality of louvers, each having a first end and a second end with a socket formed in each end;

a plurality of first louver pins each having inner and outer ends and an inwardly facing bearing surface between the ends, the outer ends of the first louver pins being received in the sockets of the first side member and the inner ends of each of the first louver pins being received in the sockets in the first ends of the louvers, each of the bearing surfaces having a diameter greater than the diameter of the louver socket in the first end of its associated louver whereby the first end of each louver can abut the bearing surface of the first pin;

the first louver pins being mounted in the first side member so that the bearing surfaces are vertically aligned, whereby the first ends of the louvers will be in alignment with each other when they are in engagement with the bearing surfaces;

a plurality of second louver pins having inner and outer ends, the second louver pins having a diameter not greater than that of the sockets in the second side member, the outer end of each second pin being received in the socket in the second side member and the inner end of each second pin being received in the socket in the second end of its associated louver;

a compression spring disposed in a majority of the sockets in the second side member and at least one of the sockets in the second side member is free of the compression spring, each compression spring engaging the outer end of its associated second pin to bias the pin inwardly of the frame under a force sufficient to urge lightly the first end of the louver against the bearing surface of the first pin to maintain the first ends of the louvers in alignment;

at least one of the louvers being urged against the bearing surface of the first pin under force sufficient to develop substantial frictional drag;

the louvers being connected together for ganged pivotal movement, said substantial frictional drag being sufficient to maintain all of the louvers in a set pivotal attitude.

2. A louvered window shutter as defined in claim 1 further comprising:

at least one tensioning mechanism mounted to the second side member, the tensioning mechanism including an internally threaded insert fixed within the second side member in axial alignment and in communication with a socket in the second side member, the threaded insert having an adjustment screw threaded through the insert for longitudinal adjustment along the common axis, the inner end of the adjustment screw being blunt and bearing against the outer end of its associated second louver pin, the outer end of the adjustment screw being accessible from the outside of the frame.

3. A louvered window shutter as defined in claim 2 wherein the tension mechanism is contained within a socket accessible from the outer surface of the second side member, the diameter of the socket greater than that of the pin-receptive socket on the inner face of the second side member.

4. A louvered window shutter as defined in either of claims 1 or 2 wherein the first and second pins are formed from material having substantially the same frictional characteristics.

5. A louvered window shutter as defined in claim 4 wherein the first and second pins are formed from a nylon.

6. A louvered window shutter as defined in either one of claims 1 or 2 further comprising a control rod connecting the louvers together for ganged movement.

* * * * *